US007314432B2

(12) United States Patent
Liao

(10) Patent No.: US 7,314,432 B2
(45) Date of Patent: Jan. 1, 2008

(54) STEPPING EXERCISE DEVICE

(75) Inventor: Hsueh-Jean Liao, Shenzhen (CN)

(73) Assignee: HL Corporation, Shenzhen (CN)

( * ) Notice: Subject to any disclaimer, the term of this patent is extended or adjusted under 35 U.S.C. 154(b) by 489 days.

(21) Appl. No.: 10/862,300

(22) Filed: Jun. 7, 2004

(65) Prior Publication Data

US 2005/0227818 A1 Oct. 13, 2005

(30) Foreign Application Priority Data

Mar. 30, 2004 (CN) ..... 2004 2 0486384

(51) Int. Cl.
*A63B 22/04* (2006.01)

(52) U.S. Cl. ..... 482/52; 601/29

(58) Field of Classification Search ..... 482/51, 482/54, 70, 71, 79, 80, 148; 434/253; 601/29–36
See application file for complete search history.

(56) References Cited

U.S. PATENT DOCUMENTS

| | | | | |
|---|---|---|---|---|
| 4,938,474 | A | 7/1990 | Sweeney et al. | |
| 5,580,338 | A * | 12/1996 | Scelta et al. | 482/62 |
| 5,645,512 | A * | 7/1997 | Yu | 482/53 |
| 5,665,033 | A | 9/1997 | Palmer | |
| 5,820,524 | A * | 10/1998 | Chen | 482/51 |
| 6,066,076 | A * | 5/2000 | Wang et al. | 482/52 |
| D456,052 | S | 4/2002 | Steves | |
| 6,626,806 | B2 | 9/2003 | Stevens | |
| 6,740,014 | B2 * | 5/2004 | Tsai | 482/115 |
| 2002/0155926 | A1 * | 10/2002 | Lat | 482/52 |

* cited by examiner

*Primary Examiner*—Jerome Donnelly
*Assistant Examiner*—Tam Nguyen
(74) *Attorney, Agent, or Firm*—Eric Karich

(57) ABSTRACT

An exercise machine is disclosed including a base, a pair of pedals pivotally mounted to the base via a pair of pivot arms, a rotating block rotatably coupled to the base, a pair of connectors each connected between one of the pivot arms and the rotating block, and a friction belt positioned about, and in contact with, a circumference of the rotating block. Moving one of the pedals towards the base causes the rotating block to rotate and the other pedal to move away from the base.

1 Claim, 2 Drawing Sheets

STEPPING EXERCISE DEVICE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

1. Field of the Invention

This invention relates generally to exercise machines, and more particularly to a stepping-type exercise machine.

2. Description of Related Art

The following patents represent the state of the art:

Palmer, U.S. Pat. No. 5,665,033, teaches an exercise machine that simulates the movements made during snow skiing to exercise the muscles used during such movements. The exercise machine includes a pair of elongate foot support arms with foot support portions mounted for simultaneous vertical and horizontal movement with the vertical movement having opposite orientations for the same direction of horizontal movement. Thus, as the foot support portions of the foot support arms move in the same horizontal direction to one side or the other, one foot support portion moves vertically upwardly while the other moves vertically downwardly so that such movement generally defines an X pattern. Movement of the foot support arms is preferably coordinated so that the arms move together in a desired manner with resistance to movement of the arms preferably being adjustable by a user of the machine to adjust the strenuousness of the exercise performed. The desired movement of the foot support portions of the foot support arms may be achieved by mounting each foot support arm for limited rotational movement about separate axis of rotation, each axis of rotation extending along the intersection of perpendicular planes. One plane for each axis of rotation is substantially perpendicular to a machine central plane, with the other planes of each axis of rotation intersecting one another. Upper body supports or handles may be provided which, if desired, can provide upper body exercise in addition to support.

Stevens, U.S. Pat. No. 6,626,806, teaches a damping assembly for a stepping-type exercising device. The exercise device includes a shaft with a base member and a rotatable member respectively mounted thereto. The base member has a first annular surface and the rotatable member has a second annular surface which is engaged with the first annular surface with a friction member clamped therebetween. A driving member is connected to the rotatable member and is connected to a power transferring member. An adjustable member is movably mounted to the shaft and a bearing is mounted to the shaft and located between the adjustable member and the rotatable member. The friction between the rotatable member and the base member can be adjustable by moving the adjustable member to compress the rotatable member toward the base member. See also Steves, U.S. Pat. No. D456,052 (sic).

These patents are hereby incorporated by reference in full.

SUMMARY OF THE INVENTION

An exercise machine is disclosed including a base, a pair of pedals pivotally mounted to the base via a pair of pivot arms, a rotating block rotatably coupled to the base, a pair of connectors each connected between one of the pivot arms and the rotating block, and a friction belt positioned about, and in contact with, a circumference of the rotating block. Moving one of the pedals towards the base causes the rotating block to rotate and the other pedal to move away from the base.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1:
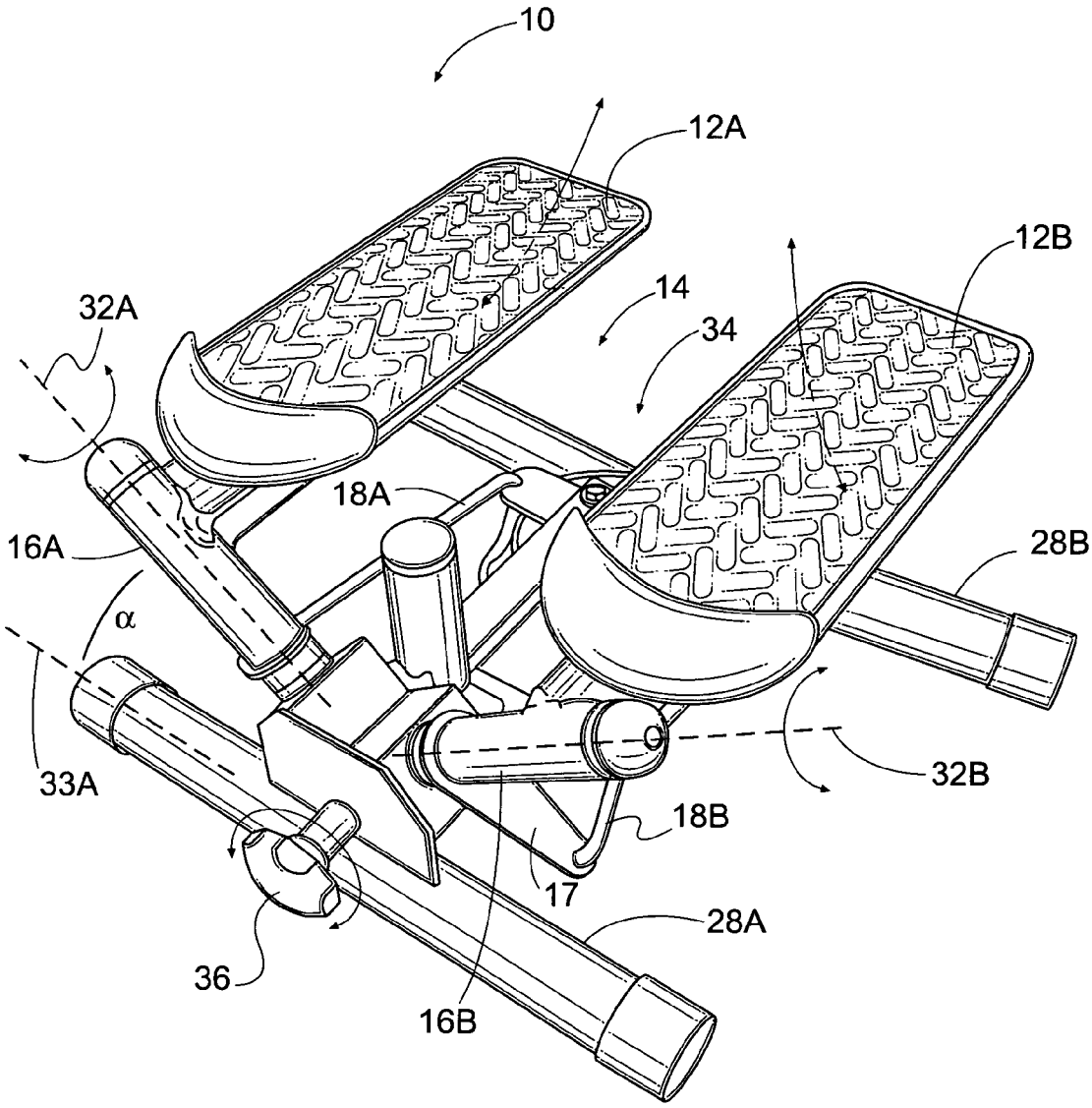
FIG. 1 is a front perspective view of one embodiment of an exercise machine including a pair of pedals pivotally mounted to a base via a pair of pivot arms, and a resistance adjustment mechanism.
Figure 2:
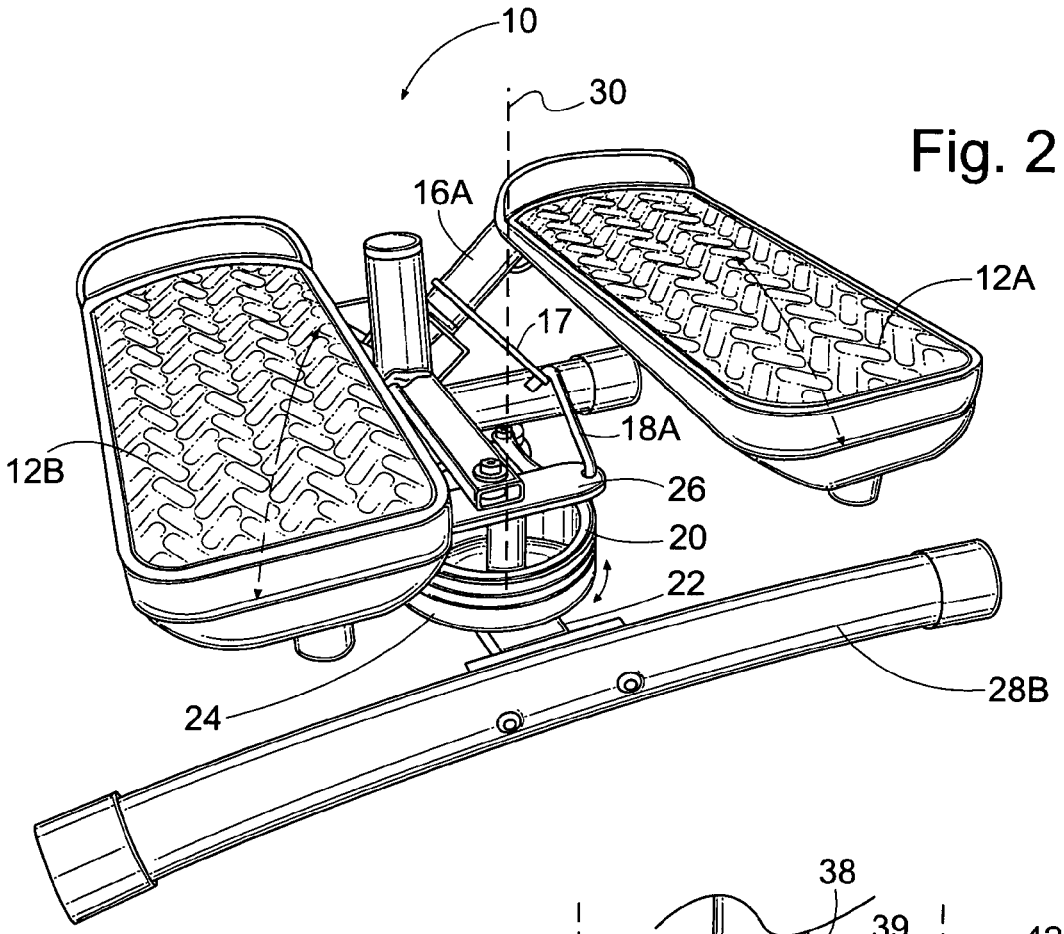
FIG. 2 is a rear perspective view of the exercise machine of FIG. 1.

FIG. 1 is a front perspective view of one embodiment of an exercise machine 10 including a pair of pedals 12A and 12B pivotally mounted to a base 14 via a pair of pivot arms 16A and 16B. As shown in FIGS. 1 and 2, in one embodiment the base 14 includes front and rear stabilizer bars 28A and 28B, and a center bar 22 that extends between the front and rear stabilizer bars 28A and 28B. A rotating block 20 is preferably rotatably connected to the center bar 22.

The pivot arms 16A and 16B are positioned in front of and below the pedals 12A and 12B. The pivot arm 16A pivots about an axis 32A extending outward from the base 14. The pair of pivot arms 16A and 16B are preferably mounted at an angle $\propto$ to the base 14. The front stabilizer 28A has an axis 33A. The angle $\propto$ between the axis 32A and the axis 33A is preferably about 45 degrees (relative to a plane defined by a center bar 22 of the base 14). The pivot arm 16B pivots about an axis 32B in a similar manner. The axes 32A and 32B are preferably substantially coplanar and separated by an angle of about 90 degrees. The exercise machine 10 may be generally classified as a stepping exercise machine, and is advantageously relatively small and simple and light enough to be highly portable.

As shown in FIGS. 1 and 2, a pair of connectors 18A and 18B connect the pivot arms 16A and 16B to the rotating block 20. In one embodiment, the pair of connectors 18 are a pair of push rods, although those skilled in the art will recognize that other connectors could also be used.

In the preferred embodiment, each of the pair of connectors 18A and 18B is connected to one of the pivot arms 16A and 16B through a lever arm 17 to increase the range of movement of the pair of connectors 18A and 18B. Each of the pair of connectors 18A and 18B is attached to the rotating block 20 at a point 25 radially spaced from the axis of rotation of the rotating block 20. In the present embodiment, the pair of connectors 18A and 18B are attached to a connection arm 26 fixedly attached to the rotating block 20. In this embodiment, the connection arm 26 includes apertures 25 in the two opposed ends, which extend outwardly from opposite sides of the rotating block 20, and each of the pair of connectors 18A and 18B fits into one of the apertures 25.

A friction belt 24 is positioned about, and in contact with, an annular outer surface 21 of the rotating block 20. The rotating block 20 rotates against a frictional force generated between the friction belt 24 and the rotating block 20. The friction belt 24 includes a brake liner 19 that provides a proper level of friction and a good wear surface against the rotating block 20.

The pedals 12A and 12B are each dimensioned to receive a foot of a human user. During expected use of the exercise machine 10, the user places one of his or her feet on the pedal 12A and the other foot on the pedal 12B. Pushing downward on one of the pedals 12 causes the corresponding connector 18 to rotate the rotating block 20 via the connection arm 26 against the frictional force generated between the friction belt 24 and the rotating block 20. The other connector 18, connected to the other end of the connection arm 26, pushes the other pedal 12 upward. For example, pushing downward on the pedal 12A causes the corresponding connector 18A to rotate the rotating block 20 via the connection arm 26 against the frictional force. The other connector 18B, connected to the other end of the connection arm 26, pushes the other pedal 12B upward. The exercise machine 10 forces muscles of the user to push against at least the frictional force generated between the friction belt 24 and the rotating block 20, thereby helping the user to develop and maintain physical fitness.

In the embodiment of FIGS. 1 and 2, the base 14 includes a front stabilizer bar 28A and a rear stabilizer bar 28B for stably positioning the base 14 on a substantially planar surface. The center bar 22 is connected between central portions of the front and rear stabilizer bars 28A and 28B. The rotating block 20 rotates in a plane parallel to a plane defined by the center bar 22 and about an axis 30 normal to the plane defined by the center bar 22.

An adjustment mechanism 34 enables the user to adjust a magnitude of the frictional force generated between the friction belt 24 and the rotating block 20, thereby adjusting a resistance opposing movement of the pedals 12A and 12B and a level of effort required on the part of the user to move the pedals 12A and 12B.

Figure 3:
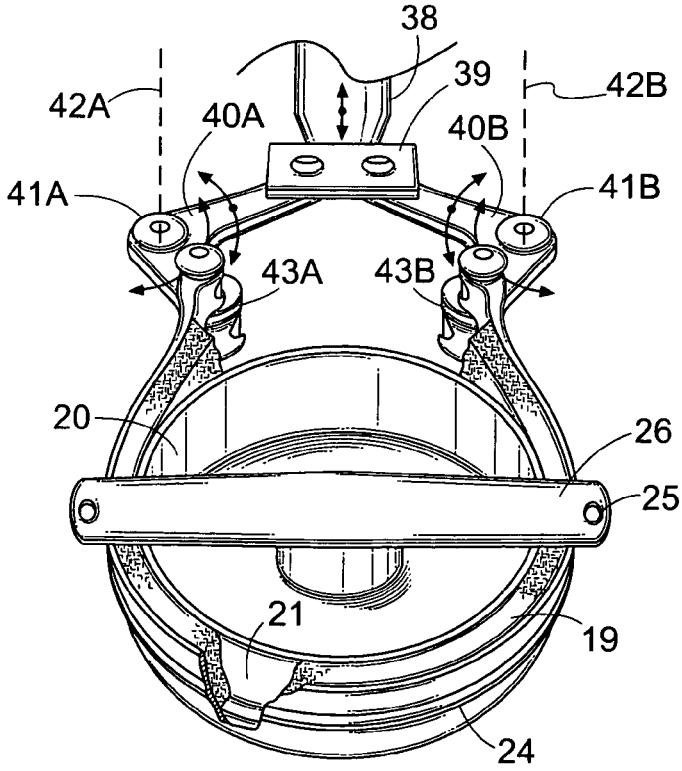
FIG. 3 is a perspective view of a portion of the resistance adjustment mechanism of FIG. 1.

FIG. 3 is a perspective view of a portion of the adjustment mechanism 34 of FIG. 1. In the embodiment of FIGS. 1-3, the adjustment mechanism 34 includes a knob 36 connected to a bar 38. Rotating the knob 36 in one direction causes the bar 38 to move linearly in a first direction, and rotating the knob 36 in the other direction causes the bar 38 to move linearly in a second direction opposite the first direction.

As shown in FIG. 3, a pair of "L"-shaped bars 40A and 40B are mounted on the base 14 with a pair of mounting bolts 41A and 41B such that the "L"-shaped bar 40A pivots about an axis 42A at the angled portion of the "L"-shape bar and the "L"-sharped bar 40B pivots about an axis 42B at the angled portion of the "L"-shaped bar The pair of "L"-shaped bars 40A and 40B are pivotally connected to an end 39 of the bar 38 and ends of the friction belt 24. The ends of the friction belt 24 are connected to pair of "L"-shaped bars 40A and 40B with connected bolts 43A and 43B. As the end of the bar 38 moves linearly toward the rotating block 20, the frictional force between the frictional belt 24 and the rotating block 20 is reduced, and as the end of the bar 38 moves linearly away from the rotating block 20, the frictional force bettween the friction belt 24 and the rotating block 20 is increased.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. An exercise machine, comprising:

a base having a center bar and a pair of stabilizer bars positioned at opposite ends of the center bar, wherein the center bar defines a horizontal plane of the base;

a pair of pedals pivotally mounted to the base via a pair of pivot arms, wherein each of the pivot arms pivot about an axis extending outward from the base at an angle of about 45 degrees relative to the plane of the base;

a rotating block rotatably coupled to the center bar of the base such that the rotating block rotates in a plane substantially parallel to the plane of the base and about an axis substantially normal to the plane of the base;

a connection arm fixedly attached to the rotating block and having two opposed ends;

a pair of connectors each connected between one of the pivot arms and one of the ends of the connection arm;

a friction belt positioned about, and in contact with, a circumference of the rotating block;

wherein moving one of the pedals towards the base causes the rotating block to rotate and the other pedal to move away from the base; and further comprising an adjustment mechanism coupled to the friction belt and configured to adjust a magnitude of a frictional force between the friction belt and the rotating block, wherein the adjustment mechanism comprises a knob connected to a bar such that rotating the knob in one direction causes the bar to move linearly in a first direction, and rotating the knob in the other direction causes the bar to move linearly in a second direction opposite the first direction, and further comprising a pair of "L"-shaped bars mounted on the base with a pair of mounting bolts such that each "L"-shaped bar pivots about an axis at the angled portion of the "L"-shaped bar, each "L"-shaped bar being pivotally connected at one end thereof to an end of the bar and the other end thereof to an end of the friction belt with bolts, such that as the bar moves linearly toward the rotating block, the frictional force between the friction belt and the rotating block is reduced, and as the bar moves linearly away from the rotating block, the frictional force between the friction belt and the rotating block is increased.

* * * * *